United States Patent [19]

Kern

[11] 4,244,487

[45] Jan. 13, 1981

[54] FLOATING COVER HAVING PIVOTALLY CONNECTED FLOTATION PONTOONS

[75] Inventor: Ronald C. Kern, Katy, Tex.

[73] Assignee: Ultraflote Corporation, Houston, Tex.

[21] Appl. No.: 25,836

[22] Filed: Apr. 2, 1979

[51] Int. Cl.[3] ..... B65D 88/34; B65D 88/36; B65D 88/40; B65D 88/42

[52] U.S. Cl. ..... 220/216; 220/218; 220/220; 220/222

[58] Field of Search ..... 220/216–227

[56] References Cited

U.S. PATENT DOCUMENTS

| | | | |
|---|---|---|---|
| Re. 29,270 | 6/1977 | Nelson . | |
| 1,712,321 | 5/1929 | Afonin | 220/218 |
| 1,903,291 | 4/1933 | Griffin | 220/224 |
| 2,070,828 | 2/1937 | Ellis et al. | 220/218 |
| 3,343,708 | 9/1967 | Haas . | |
| 3,372,831 | 3/1968 | Daniels et al. . | |
| 3,511,406 | 5/1970 | Creith et al. . | |
| 3,861,555 | 1/1975 | Nelson | 220/221 |
| 3,910,452 | 10/1975 | Szasz . | |
| 3,926,332 | 12/1975 | Okamato . | |
| 3,942,674 | 3/1976 | Nelson . | |
| 3,944,113 | 3/1976 | Heisterberg . | |
| 3,972,444 | 8/1976 | Adams . | |
| 4,018,356 | 4/1977 | Szasz et al. . | |
| 4,036,394 | 7/1977 | Bodley et al. . | |
| 4,036,395 | 7/1977 | Tuckey . | |
| 4,071,164 | 1/1978 | Skakunov . | |
| 4,116,358 | 9/1978 | Kinghorn et al. . | |

FOREIGN PATENT DOCUMENTS

| | | | |
|---|---|---|---|
| 339877 | 4/1936 | Italy | 220/216 |
| 45-15105 | 5/1970 | Japan | 220/216 |

OTHER PUBLICATIONS

Kern, "Aluminum Internal Floating Roofs", presented at the Refinery and Petrochemical Plant Maintenance Conference, Feb. 8–10, 1978.

*Primary Examiner*—Allan N. Shoap
*Attorney, Agent, or Firm*—Arnold, White & Durkee

[57] ABSTRACT

A floating cover for a tank is characterized by a pivotal interconnection between confronting ends of longitudinally adjacent flotation pontoons such that one pontoon is pivotally movable with respect to the longitudinal axis of the other pontoon when the deck of the cover flexes in response to turbulence in the liquid on which the cover is disposed or in response to any other non-uniform loading on the deck.

6 Claims, 15 Drawing Figures

FIG.3D
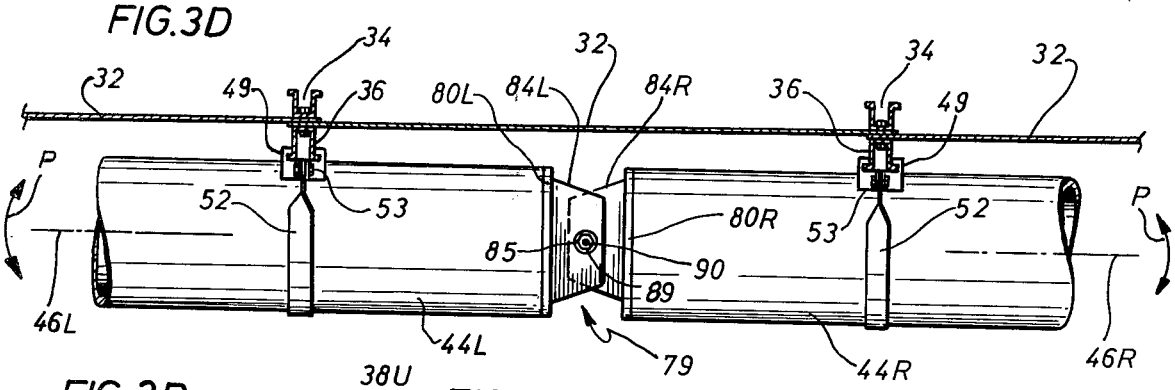
FIG.3B
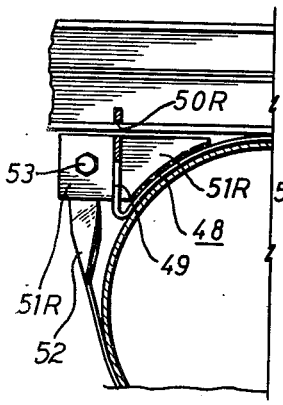
FIG.3A
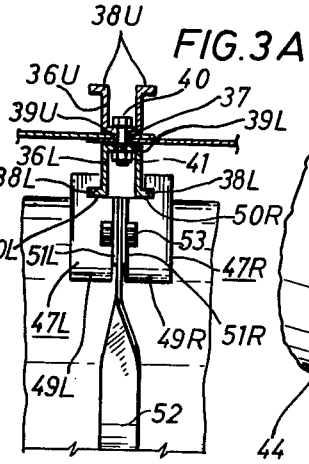
FIG.3C
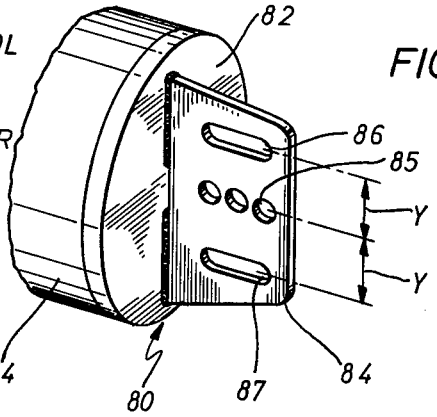
FIG.5A
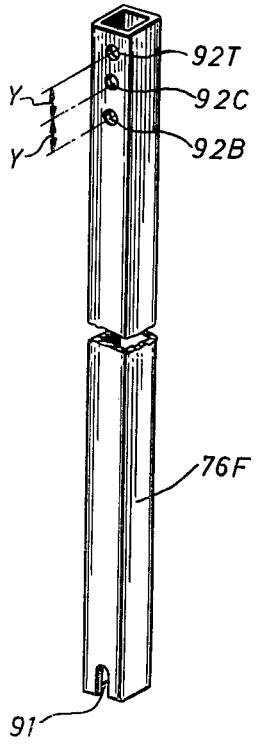
FIG.5B
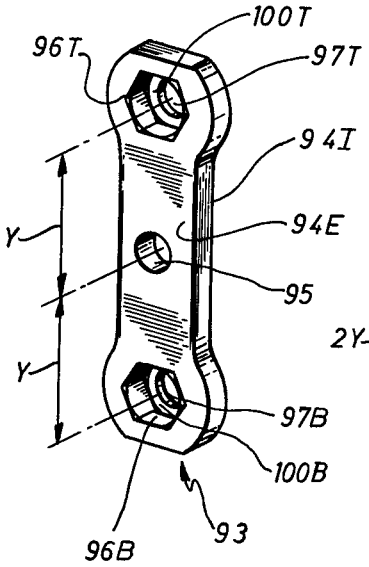
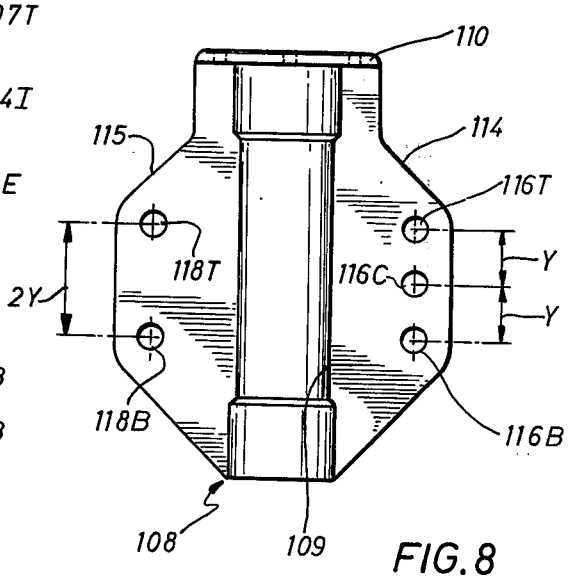
FIG.8

9B
9B
112
110
30
111
108
86R
125T
126T
46L
126B
125B
127
46R
P
44L
80L
84L
115
114
84R
87R
80R
44R
122
124
76A
91

115
125T
111
128
126T
127
114
84R
44L
80L
82L
84L
82R
44R
80R
6B
6B
104T
84R
86L
102T
85L
80R
107
106
46L
87L
102B
104B
46R
44L
44R
80L
79'
84L 76F
91
94E
93
106
82R
80R
102T
84R
102T
94I
76F
84L
82L
102T
44R
104T 44L
80L

FLOATING COVER HAVING PIVOTALLY CONNECTED FLOTATION PONTOONS

BACKGROUND OF THE INVENTION

1. Field of the Invention

This invention relates to floating covers of the pontoon type, and, in particular, to internal floating covers wherein one of two next-longitudinally adjacent pontoons is pivotally mounted and rotatable with respect to the longitudinal axis of the other.

2. Description of the Prior Art

Experience has shown that of the various efforts designed to minimize the loss of liquid products from fixed-roof storage tanks, the simplest and most economical solution is an internal cover flotationally disposed over the exposed liquid surface. Initially, various floating covers were utilized, fabricated of polyvinyl chloride, polyesters, epoxies, plastic and plastic foams, steel and aluminum. Some covers floated directly on the product while other constructions supported the covers over the product on suitable flotation devices.

Three basic types of internal covers have been developed. These were steel pan-type covers, plastic foam raft-type covers, and aluminum pontoon-type covers.

Believed exemplary of the steel pan-type covers are the devices disclosed in U.S. Pat. Nos. 3,511,406 (Creith et al.), 3,972,444 (Adams), 3,944,113 (Heisterberg), 4,036,394 (Bodley et al.), and 4,071,164 (Skakunov). The Skakunov device includes a resilient disc-shaped diaphragm resting upon a series of radially disposed telescopic arms each attached at one end to a central floating chamber and at the other end to an annular seal. The seal end of each arm is provided with a fork which is secured by a fulcrum pin to a roller to thereby effect a resilient connection to the seal.

However, due to the problems of sinking, low efficiency, and high initial cost, steel pan-type internal covers are believed to have declined in favor among users of internal covers.

Annular seal arrangements are necessary in most, if not all, internal covers (of any type) of effect a vapor seal between the periphery of the cover and the interior of the usually cylindrical tank in which they are disposed. Believed typical of such seal arrangements are U.S. Pat. Nos. 3,343,708 (Hass), 3,372,831 (Daniels et al.), 3,926,332 (Okamoto), 4,036,395 (Turkey), and 4,116,358 (Kinghorn et al.).

U.S. Pat. Nos. 3,910,452 (Szasz) and 4,018,356 (Szasz et al.) are believed exemplary of the plastic foam raft-type internal cover. Due to their tendency toward delamination, product absorption, and static sparking potential, such plastic foam raft-type covers are also believed to be falling into disfavor among users of such covers.

In view of the foregoing, it is now believed that the most effective internal cover in use is the aluminum pontoon type floating cover. One such floating cover, sold by Ultraflote Corporation under the registered trademark ULTRAFLOTE, is disclosed and claimed in U.S. Pat. No. Re. 29,270 (Nelson), a reissue of U.S. Pat. No. 3,861,555. U.S. Pat. No. 3,942,674 (also to Nelson) relates to an electrical grounding arrangement for an internal floating cover.

Internal covers typically provide downwardly depending legs or struts for the purpose of supporting the cover above the bottom of the tank when the liquid product is withdrawn therefrom. Examples of the use of such depending support legs in a foam raft-type cover and in an aluminum pontoon-type cover are believed to be respectively disclosed in U.S. Pat. No. 3,910,452 (Szasz) and in U.S. Pat. No. Re. 29,270 (Nelson), both alluded to above.

It is believed that all manufacturers of aluminum pontoon-type covers utilize a rigid joint between longitudinally adjacent pontoons and fixedly support the depending legs at these locations. The rigid connection is utilized because it is the easiest to fabricate and properly install. Moreover, since the pontoons are the strongest portion of the cover and function as the main structural beams, it is most efficient to utilize a rigid joint therebetween and to attach the legs at that joint.

In other instances, as set forth in the referenced U.S. Pat. No. Re. 29,270, it is advantageous to have the capability of varying the length of the depending legs. Thus, the adjustable leg may be received within a sleeve attached through the deck. The sleeve is held securely to brackets which rigidly join adjacent longitudinal ends of pontoons together. The length of the leg may be adjusted from above the deck, through the sleeve.

Structurally, a rigid joint at the interconnection of the ends of longitudinally adjacent pontoons makes the pontoons act as a continuous beam. As is well known, a continuous beam is stronger than a series of simple beams, but, under uniform load, approximately twice the moment is imposed at the connections than at the midpoint of the spans. This fact has been outweighed by the perceived simplicity of a rigid joint.

It has been observed that high turbulence in a localized portion of the liquid has a tendency to raise and lower the cover unevenly, causing it to flex in some cases more than would be expected. The general background of aluminum internal floating roofs, as well as an explanation of the causes of various turbulent forces which are generated in the liquid product, is set forth in a paper, "Aluminum Internal Floating Roof", MC-78-6, by Ronald Carl Kern, presented at the Refinery and Petrochemical Plant Maintenance Conference, Feb. 8–10, 1978. Although aluminum pontoon-type internal floating covers inherently have some flexibility associated therewith as a result of their construction, especially due to the bending of the metal in the end plates of the pontoons, it can be shown that the turbulence may be of such severity that the end plate connected to each end of a pontoon may rupture after repeated flexings. Thus, under cyclic loading generated by severe turbulence, the welded joints at the ends of adjacent pontoons may break. This, of course, is disadvantageous.

In view of the foregoing, it is believed to be advantageous to provide a floating cover for internal or external use wherein the confronting ends of longitudinally adjacent flotation pontoons are pivotally mounted such that one pontoon is relatively movable with respect to the longitudinal axis of the other and that one pontoon may pivot with respect to the other as the cover flexes in response to turbulence in the liquid product or other non-uniform loading on the cover.

It is believed to be of further advantage to provide a floating cover wherein either fixed-length or adjustable-length support legs may be rigidly connected to and supported from one of two confronting ends of longitudinally adjacent pontoons with the end of the other pontoon being pivotally connected to the leg-first pontoon interconnection such that the second pontoon is pivotal relative to the longitudinal axis of the first pontoon. In this manner, it is believed to be advantageous to define a degree of relative pivotal rotative motion between longitudinally adjacent pontoons to thereby allow uplifting of the cover due to turbulence or to other non-uniform loading on the cover to cause flexure at the pivotal joint without stressing the welded end plate-pontoon connections. As a further result, each pontoon is permitted to act as a simple beam when the cover is supported by the legs without any moment in the end connection.

SUMMARY OF THE INVENTION

This invention relates to a floating cover for a liquid storage tank having a deck flotationally supported by pontoons wherein the confronting ends of longitudinally adjacent flotation pontoons are pivotally connected one to the other such that one pontoon may pivot with respect to the longitudinal axis of the other when the deck flexes in response to turbulence in the liquid disposed within the tank or any other non-uniformity in loading placed on the deck. The invention may be used in either internal or external floating covers for storage tanks.

In an embodiment of the invention, the end plate disposed at one end of one pontoon is rigidly connected to a fixed-length support leg while the end plate disposed at the confronting end of the other pontoon is pivotally mounted to the rigid interconnection so defined. In this embodiment, any given pontoon is rigidly secured at one end thereof to a fixed-length support leg while the other end thereof is pivotally mounted to a rigid pontoon-fixed leg joint.

Another embodiment of the invention utilizes an adjustable length leg housing rigidly secured to the end plate of one end of one pontoon while the end plate of the confronting end of the next-longitudinally adjacent pontoon is pivotally mounted to the leg housing.

In all embodiments of the invention, one end of one pontoon is pivotally mounted to the confronting end of the next-longitudinally adjacent pontoon such that one pontoon is pivotally rotatable with respect to the longitudinal axis of the other pontoon to thereby accommodate flexure of the deck in response to turbulent forces within the liquid on which the cover is disposed or in response to any other non-uniformity in loading on the cover.

BRIEF DESCRIPTION OF THE DRAWINGS

The invention will be more fully understood from the following detailed description thereof taken in connection with the accompanying drawings, which form a part of this application, and in which:

FIG. 3D is an enlarged elevational view of a portion of the cover illustrating one embodiment of the invention wherein confronting ends of next-longitudinally adjacent deck support pontoons are pivotally mounted one to the other;

FIGS. 3A and 3B are, respectively, an enlarged side elevational view and an end view of a clamping arrangement whereby adjacent sheets forming the deck of the cover are joined together and whereby the deck support pontoons are suspended from the deck;

FIG. 3C is an isolated perspective view of a pontoon end plate used in connection with each embodiment of the invention;

FIG. 5A is an isolated perspective view of a fixed-length support leg used in connection with the embodiment of the invention shown in FIG. 4;

FIG. 5B is an isolated perspective view of a pivot bar used in connection with the embodiment of the invention shown in FIG. 4;

FIG. 8 is an isolated perspective view of a leg housing used in connection with the embodiment of the invention shown in FIG. 7.

DESCRIPTION OF THE PREFERRED EMBODIMENT

Figure 1:
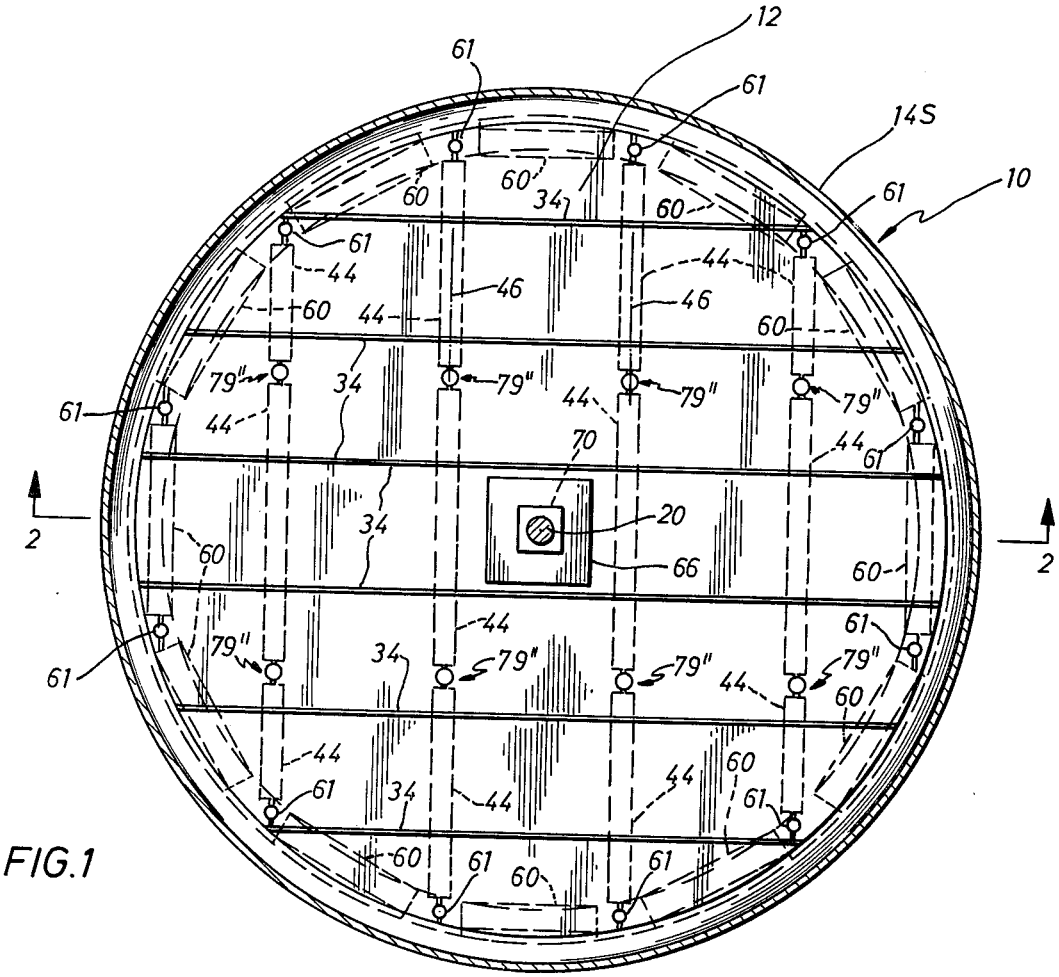
FIG. 1 is a plan view of a floating cover for a tank, with the tank in which the cover is disposed being shown in section.

Throughout the following description similar reference numerals refer to similar elements in all figures of the drawings.

Figure 2:
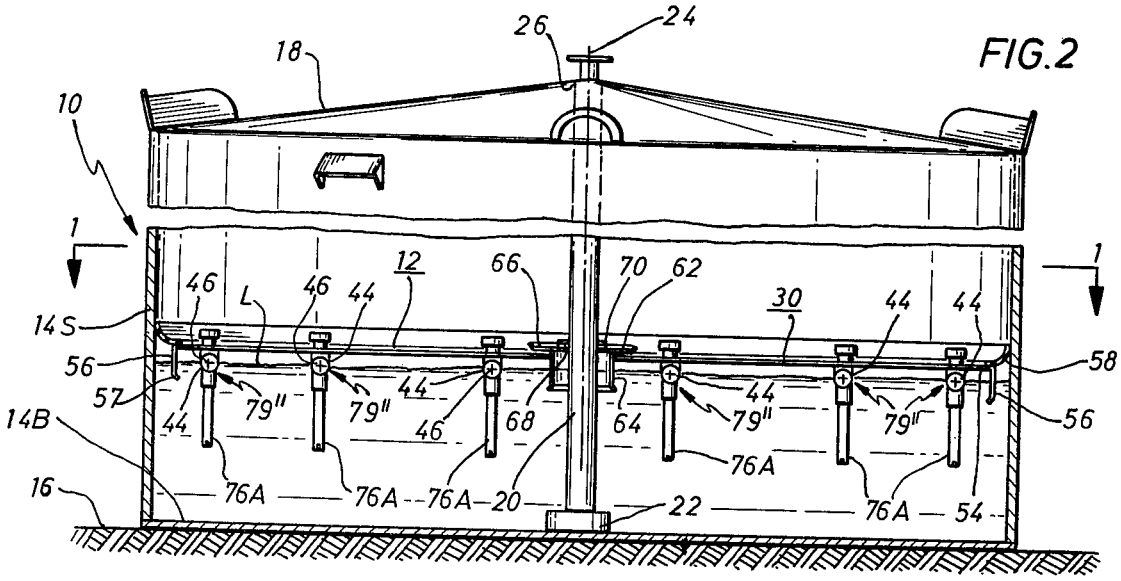
FIG. 2 is a side elevational view taken along section lines 2—2 in FIG. 1 illustrating a cover in accordance with the invention disposed flotationally within the tank.

With reference to FIGS. 1 and 2, respectively shown are a plan view and a side elevational view of a tank 10 in which a floating cover 12 embodying the teachings of this invention is disposed. The tank 10 is fabricated from a plurality of welded steel plates which form a base 14B and sidewalls 14S in a conventional manner. The tank 10 is disposed on any suitable foundation 16 in a manner known to those skilled in the art. The tank 10 is provided with a structurally integral cover 18 which is supported away from the base by one or more support columns 20. Although the cover 12 is shown in the figures and discussed herein as disposed on the interior of the tank 10 as an internal floating cover, it is to be understood that a floating cover in accordance with this invention may also be utilized in an external floating cover environment wherein the tank in which the floating cover 12 is disposed does not include a structurally integral cover. In FIGS. 1 and 2 only one such support column 20 is illustrated, that extending from a pedistal 22 centrally and axially along the vertical axis 24 of the tank and terminating adjacent to the interior apex 26 of the structurally integral cover 18. Conventional roof vents are disposed in the structurally integral cover 18 and in the tank sidewalls 14S in a manner appreciated by those skilled in the art. The vents are typically utilized with internal floating covers except when the interior is purged with nitrogen or some other inert gas.

The tank 10 is typically utilized to store a predetermined level L of liquid hydrocarbons. It has been found that disposition of liquid hydrocarbons within the tank usually leads to the generation of losses therefrom due to evaporation or other mechanisms. It is for the purpose of minimizing the loss of liquid hydrocarbons through evaporative or other mechanisms that floating covers are supported on the surface of the liquid. As mentioned, the floating covers may be used internally or externally of the tank and remain within the scope of this invention.

Typically, such internal floating covers include a substantially planar deck 30 fabricated of a plurality of metal sheets 32 (FIG. 3D) secured together by a suitable clamping mechanism 34. The clamping mechanism 34 (best seen in FIGS. 3A, 4 and 7) includes an upper and lower clamp beam 36U and 36L, respectively. Each clamp beam 36 is a substantially U-shaped channel member extending any suitable axial length, typically thirty feet. Each beam 36 has an array of openings 37 disposed in the closure piece at the base of the arms of the "U", with the openings being centered on the axial centerline of the beam 36 with appropriate axial spacing defined between adjacent openings. Each clamp beam 36 has outwardly extending flanges 38 disposed at the free ends of the arms.

As seen in FIG. 3A, the exterior surface 39U of the closure piece of the upper clamp beam 36U has a convex, or outwardly bowed, surface provided with roughened serrations or corrugations thereof. The exterior surface 39L of the closure piece of the lower clamp beam 36L is provided with a concave, or inwardly bowed, surface having roughened serrations or corrugations thereon.

The ends of adjacent metal sheet 32 of the deck are overlapped one with the other and sandwiched between the exterior surfaces 39 of the upper and lower clamp beams 36. A through bolt 40 is provided through registered openings 37 in the upper and lower clamp beams as well as through holes appropriately located in the overlapped portions of the deck plates 32. A nut 41 is secured to the bolt 40 and draws the clamp beams 36 toward each other such that a metal-to-metal seal between the overlapped deck plates is effected as the outwardly bowed surface 39U of the clamp beam 36U is drawn toward the inwardly bowed surface 39L of the lower clamp beam 36L.

It is noted that the engaged upper and lower clamp beams 36 are symmetrical about the vertical axial centerline and substantially symmetrical about the horizontal mating plane (except for the outwardly and inwardly bowed clamping surfaces). The symmetrical arrangement described above is believed to generate uniform clamping pressure throughout the axial length of the beams 36.

Buoyant forces sufficient to maintain the deck above the surface of liquid disposed within the tank are imparted to the deck 30 by the provision of a plurality of deck support pontoons 44. The pontoons are typically hollow, substantially tubular members, approximately thirty feet in length, which are disposed in end-to-end adjacency and are arranged such that the aligned axes 46 of each pontoon extend substantially transversely to the clamping arrangements 34. The deck support pontoons are secured adjacent the underside of the deck 30 by a saddle arrangement 47R and 47L (FIG. 3A) disposed on each lateral side of the lower clamp beam 36L. Each saddle arrangement includes a rigid saddle piece 48 (FIG. 3B) having a bend therein and arranged to overlie approximately the top third, or the top 120 degrees, of the portion of the pontoon 44 on each side of the lower clamp beam 36L. The saddle piece is bent vertically upwardly at each end thereof to define faces 49 (FIG. 3B). The faces 49 have notches 50 cut thereinto, the notches 50 being sized to engage the flange 38 from the lower clamp beam 36L proximal thereto, as illustrated in FIG. 3A. Flat bars 51, each having a cutout therein, are welded to the vertical edges of the faces 49 and to the curved portion of the saddle piece overlying the pontoon on each side of the axis 46 of the pontoon 44. A clamping strap 52 undergirds the pontoon 44. The clamping strap 52 is bent ninety degrees at its ends and the bent ends are received between the confronting faces of the flat bars 51 on each lateral side of the axis 46 of the pontoon (FIG. 3A). A nut and bolt arrangement 53 secures the confronting faces of the flat bars 51 and the upper ends of the strap 52 on each side of the axis of the pontoon in the described assembled relationship. The pontoons 44 are thus positioned beneath the deck 30.

Since the floating cover 12 is typically used in tanks 10 which present a circular cross-section when viewed in the plan, the periphery of such floating covers is provided with a horizontally extending rim plate 54 (FIGS. 2, 4 and 7) secured to the underside of the metal sheets by any suitable attachment means. A portion of the rim plate 54 bends vertically downwardly, as at 56, to penetrate the level of liquid within the tank beneath the cover such that vapors cannot escape along the lower edge thereof. A ramp edge is formed at the lower and upper edges 57L and 57U, respectively, of the rim plate 54.

To form a sliding seal between the surface of the deck 30 and the sidewalls 14S of the tank, a molded flexible sealing member 58 is clamped or otherwise attached about the periphery of the deck 30. The seal is biased and remains in engagement with the sidewalls 14S of the tank even if the tank is eccentric or the cover horizontally shifts. This seal exerts a powerful self-centering action on the cover.

An array of shorter rim pontoons 60 (FIGS. 1, 4 and 7) are disposed between the ends of the deck support pontoons 44 adjacent the periphery of the cover 12. The ends of the pontoons 44 are attached to the rim plates 54 in the vicinity of the rim pontoons through a pontoon-to-rim plate clip as indicated in FIG. 1 at 61.

Figure 4:
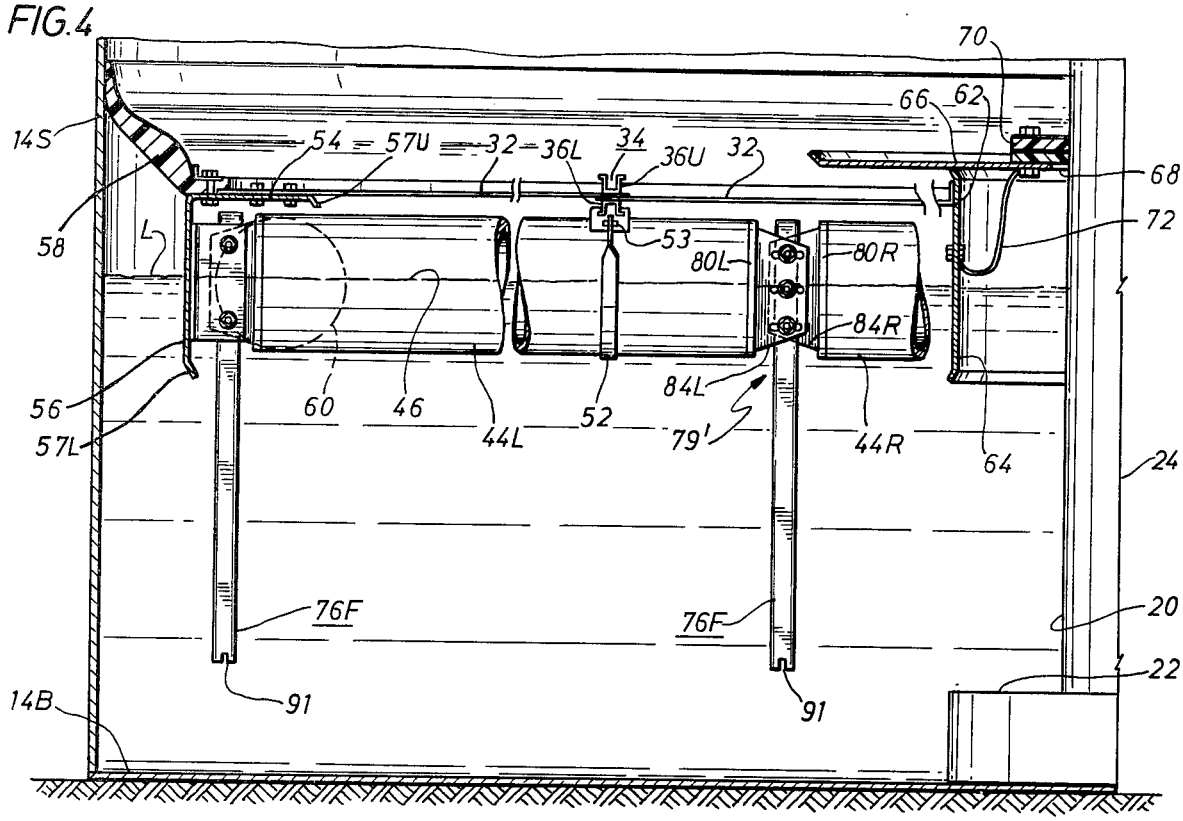
FIG. 4 is an enlarged side elevational view showing a second embodiment of the invention wherein one confronting end of two next-longitudinally adjacent deck support pontoons are pivotally mounted to a fixed-length support leg.
Figure 7:
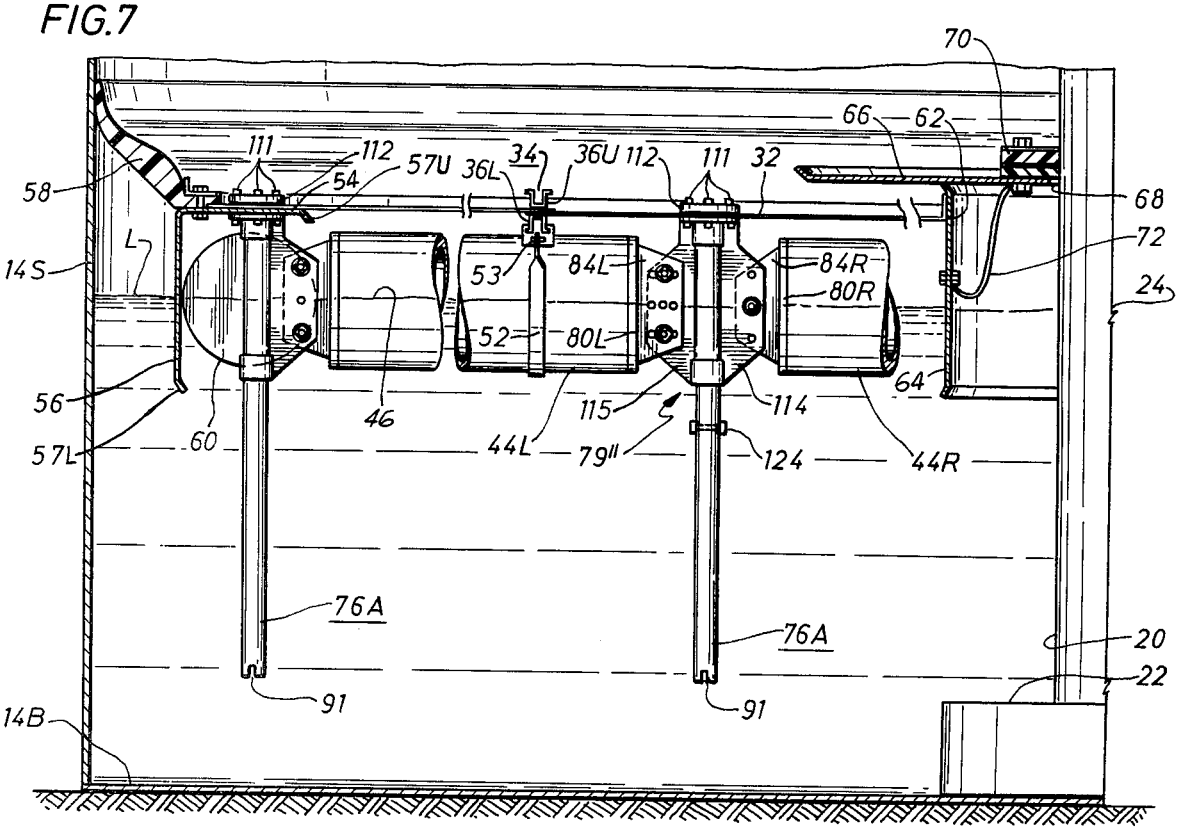
FIG. 7 is an enlarged side elevational view similar to FIG. 4 showing a third embodiment of the invention wherein one confronting end of two next-longitudinally adjacent deck support pontoons is pivotally mounted to an adjustable-length support leg.

To accommodate those locations at which a vertically extending support column, such as the central column 20, extends upwardly through the cover 12 within the tank, an opening 62 is defined in the metal sheets 32 substantially adjacent the location at which the column 20 extends through the cover 12. A vertically extending wall 64 is disposed about the opening 62. The upper edge of the vertical wall 64 is slideably disposed adjacent the undersurface of a horizontal plate 66 having an opening 68 therein. Seals 70 are disposed about the opening 68 and engage the support column 20 to prevent the leakage of vapor therethrough. For clarity of illustration the covers shown in FIGS. 4 and 7 are broken so as to accommodate the illustration of the seal 70 and supporting structure thereof.

Since the wall 64 slides with respect to the bottom of the plate 66, the seal 70 does not interfere with lateral movements of the cover within the tank. When the cover rises within the tank, the wall 64 exerts an axially upwardly directed force along the seals 70 to move them along the support column 20. When the cover descends within the tank, the seal 70 slides under the influence of gravity axially downwardly along the column 20. If the seals become stuck at any point along the column 20, a pair of normally slack metal cables 72 are provided to connect the plate 66 to the wall 64 and thereby draw the seals 70 downwardly. The cables 72 are also utilized to electically ground the plate to the rest of the cover. Only one such cable 72 is illustrated in FIGS. 4 and 7, the other cable 72 being typically disposed symmetrically to the axis 24 of the tank. The wall 64 and the plate 66 are also provided with ramp edges similar to those on the rim plate 54.

The foregoing description substantially describes conventional floating covers and is substantially set forth in U.S. Pat. No. Re. 29,270. To the extent necessary, those portions of the commonly owned referenced reissue patent which pertain to the hereinabove described structural elements of the floating cover are hereby incorporated by reference.

In order to provide a suitable support arrangement to maintain the cover spaced above the bottom 14B of the tank when the liquid hydrocarbon has been extracted therefrom, it is a common practice in the art to provide an array of downwardly extending legs 76. The legs 76 typically depend from the undersurface of the deck 30. In other instances when an adjustability of the length of the leg is desired, it is also known to provide an arrangement whereby the legs are of adjustable length (as in FIGS. 1, 2, 7 and 9).

It is practice in the art to locate the support for the legs at those locations where longitudinal ends of adjacent deck support pontoons are proximal and confront one with the other. Typical construction in the art disposes a rigid connection in the form of a closure plate for each of the pontoons which cooperate to define a housing in which the leg (either fixed-length or adjustable) is supported. Structurally, a rigid joint at the intersections between the longitudinal ends of adjacent pontoons makes the pontoons act as a continuous beam. In general, although a continuous beam is stronger than a series of simple beams, under a uniform load nearly twice the moment is imposed at the connections than at the midpoint of the span. Since the floating covers are usually very lightly loaded, the disadvantages generated by the rigid joint have been ignored in view of the structural simplicity and ease of manufacture provided thereby.

However, it has been observed that high turbulence generated from various causes can raise or lower the cover unevenly or flex it far more than has been expected by the art. Under such localized turbulent conditions, it is possible that the welded connection between the pontoon end plate and the pontoon itself would be exposed to the highest forces and conceivably would rupture after repeated flexing. Of course, other conditions, such as an uneven tank bottom, can also impose non-uniform loading on the deck.

In view of this observation, it is in accordance with this invention to provide for relative rotative movement between the confronting ends of next-longitudinally adjacent pontoons so that flexing of the cover in response to localized turbulent conditions or other non-uniformity in deck loading may be accommodated without the danger of fracture of the end plate-pontoon interconnection. Thus, instead of the rigid interconnection between longitudinal ends of adjacent pontoons it is the teaching of this invention to provide a pivotal interconnection at the confronting longitudinal ends of the pontoons such that a predetermined amount of relative rotation can occur therebetween. The pivotal interconnection is to be effected whether or not a support leg is disposed at the interconnection. Thus, as a result, each pontoon may act as a simple beam when the cover is supported on its leg without any movement in the end connection. Although this arrangement does increase the moment at the center of each pontoon, such moments can be accommodated by utilizing pontoons of an appropriate maximum length. The appropriate maximum pontoon length lies in the range of 25 to 30 feet, although other lengths may be utilized depending upon details of design and deck loading. As an advantage, however, the degree of relative rotative movement permits uplifting or flexure at the interconnection between the ends of adjacent pontoons in response to localized turbulence or non-uniform loading without the stressing of the welded joints between the end plates and the pontoons.

In accordance with the foregoing, attention is directed to FIG. 3D which is an enlarged elevational view of the pivotal interconnection generally indicated by numeral 79 between longitudinally adjacent pontoons.

As indicated in the figures, the confronting ends of pontoons 44L and 44R, respectively, (which define the pontoons to the left and right of the pivotal interconnection) are shown. In accordance with this invention, each end of the pontoons 44L and 44R is provided with an end plate 80 suitably attached as by welding. As seen in FIG. 3C, the end plate 80 in accordance with this invention includes a substantially planar portion 82 adapted for mounting about the periphery of the edges of the confronting ends of the pontoons 44 and a flange portion 84 projecting normal to the planar portion 82. The flange 84 may be provided with an array of openings 85, the centers of which lie on a line which is coincident with the axis of the pontoon to which it is attached. The flange also contains an elongated upper slot 86 and an elongated lower slot 87, the centerlines of the slots 86 and 87 being spaced distances Y above and below the line of centers of the openings 85. The array of openings 85 is provided so that the degree of overlap between adjacent flanges 84L and 84R may be varied as desired when the pontoons are joined. The slots 86 and 87 are sized to accommodate pivotal interconnection between flanges 84 through any of the openings 85 therein. For convenience, only one opening 85 is shown in FIG. 3D.

In order to provide a pivotal interconnection 79 between the flanges and end plates on adjacent pontoons 44, a stainless steel pivot bolt 90 is inserted transversely to the aligned longitudinal axes 46 of the pontoons 44 through selected registered openings 85 provided in the flanges 84L and 84R. With the bolt 90 snugly secured, as by a nut 89, a pivotal interconnection is provided between adjacent ones of the pontoons 44. Any suitable material other than stainless steel may be utilized for the bolt 90, so long as the material selected will not contaminate the liquid if a portion of the bolt wears due to abrasion during pivotal movement of one pontoon with respect to the other. With the pivotal interconnection being effected at each pontoon-to-pontoon joint throughout the entirety of the cover 12 in accordance with this invention, one of the pontoons (44R, for example) may respond to flexing of the deck in response to localized turbulent forces or any other non-uniform loading on the deck by appropriately pivoting in the direction of arrows P with respect to the axis of the other pontoon (44L, for example), to thus minimize the possibility that the end plates may be ruptured from their connection to the pontoons. In an arrangement as shown in FIG. 3D, support legs (if desired) may be conveniently mounted at appropriate locations, as at the support bars 36.

As noted above, it is usually advantageous to locate the support legs 76 at the interconnection between longitudinally adjacent pontoons 44. With reference now to FIGS. 4, 5 and 6, it may be appreciated that a fixed-length support leg 76F may be mounted at the pivotal interconnection 79' of longitudinally adjacent pontoons 44 so that any one leg 76F is both rigidly supported to one of the adjacent pontoons (as the pontoon 44L) to accomplish its support function and pivotally connected to the other of the adjacent pontoons (as the pontoon 44R) so as to permit flexing of the cover 12 to accommodate localized turbulence or non-uniform loading. With reference to FIG. 5A, the fixed-length support legs 76F may take the form of a substantially retangular hollow tube having a drainage notch 91 disposed at one end thereof. An array of openings 92 is disposed in registration through opposed sides of the tube at the end thereof distal from the notch 91. For a purpose made clearer herein, each of openings 92T (TOP), 92C (CENTER) and 92B (BOTTOM) are spaced a distance Y between the other.

In accordance with this embodiment of the invention, a pivot bar 93 shown in FIG. 5B is provided with an exterior surface 94E and an inner surface 94I. A central through bore 95 is provided centrally of the pivot bar 93. Top and bottom hexagonal recesses 96T and 96B, respectively, are disposed in the pivot bar and extend thereinto but do not completely perforate the body of the pivot bar. Instead, each recess 96T and 96B has a counterbore 97T and 97B communicating therewith and with the inner surface 94I of the pivot bar 93. Layers of material 100T and 100B between the lower end of each of the hexagonal recesses and the inner surface 94I of the pivot bar act as structurally integral washers for the pivot bar 93. The centers of the recesses 96 and the through bore 95 are spaced a distance Y above the other.

Figures 6A, 6B, 9A, 9B:
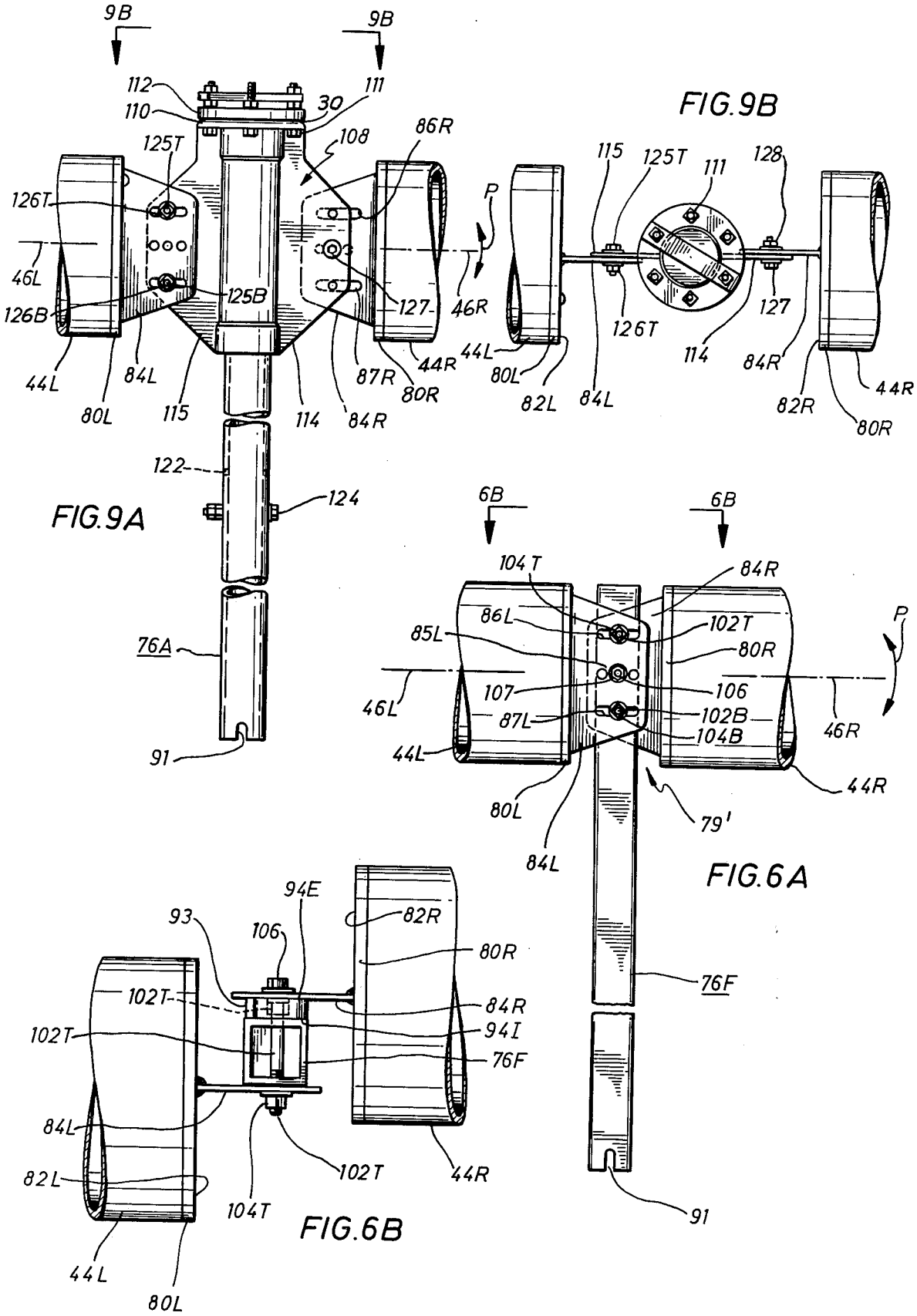
FIGS. 6A and 6B are, respectively, an enlarged side elevational and a plan view of the pivotal interconnection of one of two next-longitudinally adjacent deck support pontoons and the fixed-length support leg in accordance with the embodiment of the invention shown in FIG. 4.
FIGS. 9A and 9B are, respectively, an enlarged side elevational view and a plan view of the pivotal interconnection of one of the next-longitudinally adjacent deck support pontoons with the leg housing in accordance with the embodiment of the invention shown in FIG. 7.

As best shown in FIGS. 6A and 6B, to mount the fixed-length leg 76F at the pivotal interconnection 79' of next-longitudinally adjacent pontoons 44L and 44R, the inner surface 94I of the pivot bar 93 is disposed against one of the faces of the fixed-length leg 76F. A top through bolt 102T is inserted through the top hexagonal recess 96T and counterbore 97T, through the registered top openings 92T in the fixed-length leg, and through the upper slot 86L in the flange of the end plate 84L. Similarly, a bottom through bolt 102B is provided through the bottom hexagonal recess 96B and counterbore 97B in the pivot bar 93, through the registered bottom openings 92B in fixed-length leg 76F and through the bottom slot 87L in the flange of the end plate 84L. However, it may be appreciated that the heads of the top and bottom bolts 102, when provided with suitable nuts and washers, as at 104, are drawn within the hexagonal recesses 96 so that the substantially planar exterior surface 94E of the pivot bar is unimpeded by the projecting hexagonal heads of the bolts 102. It may also be appreciated that in this manner the pontoon 44L is rigidly connected to the fixed-length leg 76F.

To effect a pivotal interconnection 79' between the fixed leg 76F-pontoon 44L connection and the confronting end of the longitudinally adjacent pontoon 44R, the flange 84R thereof is brought in next-adjacency to the exterior surface 94E of the pivot bar 93, and a central pivot pin 106 (again, stainless steel or other suitable material) with a washer (not shown) is extended through one of the openings 85R in the array of openings provided therein, through the through bore 95 in the pivot bar 93, through the central ones 92C of the openings provided in the fixed-length leg 76F and then through one of the openings 85L in the array of openings provided in the flange 84L of the pontoon 44L. With a suitable lock nut and washer, as at 107, snugly tightened, it may be seen that the right-hand pontoon 44R is pivotally interconnected with the next-longitudinally adjacent pontoon 44L while relative pivotal motion of the other pontoon in the direction of arrows P with respect to the longitudinal axis of the first may be accommodated through the pivotal interconnection 79' of the next-longitudinally adjacent pontoon. In this manner the purposes of the instant invention may be effectuated. It should also be noted that, in connection with this embodiment of the invention, at any location where the ends of longitudinally adjacent deck support pontoons are proximal to and confront each other, the end of one pontoon is rigidly connected to a fixed-length support leg while the other of the pontoons is pivotally connected so as to be rotationally movable with respect thereto.

It is also at times desirable to provide an adjustable length leg for use in connection with floating covers. To effect this purpose in accordance with the teachings of this invention, an adjustable leg housing 108 such as that described in connection with FIG. 8 is utilized. The adjustable leg housing 108 includes a substantially hollow tubular body 109 having an upper lip 110 with an array of openings therein. The housing 108 is secured from under the deck 30 to appropriate openings therein by the connection of bolts 111 (FIG. 9A) to a clamp ring 112 provided above the deck 30. As noted, an adjustable leg 76A arrangement is shown in FIGS. 1, 2, 7 and 9.

Diametrically opposed ears 114 and 115 extend from the body 109 of the leg housing 108. The ear 114 has three openings 116T, 116C and 116B provided therein, the openings being spaced a distance Y between the centers thereof. The distance Y corresponds to the distance between the centers of the slots 86 and 87 and the central openings 85 provided in the flanges of the end plates. The other of the ears 115 is provided with top and bottom openings 118T and 118B, respectively, with the distance between the centers thereof equaling the distance 2Y.

The tubular body portion 109 of the leg housing 108 is adapted to slideably receive therewithin a suitable tubular leg 76A (FIG. 9A) which may be provided with a drainage notch 91. The leg 76A has a plurality of openings 122 drilled transversely with respect to the axis along the length thereof. The openings 122 receive a sliding stop 124 which abuts against the lower end of the tubular portion 109 of the leg housing 108 to effectively define a selectively adjustable length for the leg. With the leg 76A inserted from the upper surface of the floating cover through the aligned openings in the leg housing 108 and the clamp plate 112, the stop 124 is inserted at the appropriate opening 122 along the length of the adjustable leg. Thus, when the liquid is withdrawn from the tank 10 the cover will slide along that portion of the leg above the stop 124 until the lower edge of the tubular housing 108 rests against and is supported on the projecting stop 124. In this way the cover is supported above the base 14B of the tank a distance equal to the distance between the stop 124 and the lower edge of the leg.

In accordance with this embodiment of the invention, the pontoon 44L is secured to the ear 115 of the leg housing 108 having the openings 118T and 118B therein. Bolts 125T and 125B are inserted through the openings 118T and 118B and respectively engage the flange 84L through the slots 86 and 87 thereof. With the bolts 125 secured, as by nuts and washers at 126T and 126B, respectively, the leg housing 108 is securely and rigidly affixed to the left pontoon 44L.

The right pontoon 44R is mounted for pivotal movement with respect to the axis of the other pontoon at the interconnection 79'' (as indicated also in FIGS. 1 and 2) by the provision of a bolt and washer, as at 127, through the central opening 116C of the ear 114 and one of the array of openings 85R provided in the flange 84R of the end plate 80R. With the bolt 127 (fabricated of stainless steel or other suitable material) locked by a nut and washer, as at 128, pivotal motion of the pontoon 44R in the direction of arrows P with respect to the axis of the pontoon 44L may occur when the deck 30 flexes in response to localized turbulence in the liquid or any other non-uniformity in deck loading, as for example, that due to an uneven or sloped tank bottom. It should be appreciated, of course, that in FIGS. 3, 4 and 7, due to the pivotal interconnection arrangements 79, 79' and 79'', the pontoon 44L is also pivotally movable with respect to the axis of the other pontoon.

In view of the foregoing description of the invention, it may be readily understood that the pivotal interconnection of longitudinally adjacent deck support pontoons 44 permits a range of pivotal motion to occur between one pontoon and the axis of the next-longitudinally adjacent pontoon. In this way, one of the pontoons 44 may pivot relative the axis of the other sufficiently so that the deck 30 may flex in response to local turbulence in the liquid or in response to any non-uniformity in deck loading and yet not endanger the interconnection of the floation support pontoons.

Those skilled in the art, once having benefit of the teachings of the invention, may effect numerous modifications to the preferred embodiment of the invention as described herein. However, it is to be understood that these modifications fall within the contemplation of the invention, as defined in the appended claims.

What is claimed is:

1. A floating cover for a liquid storage tank comprising:

a deck;

a first deck support pontoon adopted to flotationally support the deck on the surface when a liquid is disposed within the tank;

a fixed-length leg mounted rigidly to the first deck support pontoon; and, a second deck support pontoon adapted to flotationally support the deck on the surface, the second pontoon being pivotally interconnected to the fixed-length leg so that the second pontoon may pivotally rotate with respect to the longitudinal axis of the first pontoon when the deck flexes in response to turbulence within a liquid disposed within the tank or in response to other non-uniform loading on the deck.

2. The floating cover of claim 1 wherein each of the first and second pontoons is provided with an end plate having a flange thereon, the flange having an opening therein, and wherein the flange associated with the first pontoon is rigidly secured to the fixed-length leg through the opening therein and the flange associated with the second pontoon is pivotally mounted to the fixed-length leg through the opening therein.

3. The floating cover of claim 1 wherein each of the first and second pontoons is provided with an end plate having a flange thereon, each flange having a central opening centered on a line coincident with the axis of the pontoon to which it is affixed, each flange further having a top and a bottom slot spaced above and below the opening therein, and wherein the flange is associated with the first pontoon is rigidly secured to the fixed-length leg through the top and bottom slots and the flange associated with the second pontoon is pivotally mounted to the fixed-length leg through the central opening therein.

4. A floating cover for a liquid storage tank comprising:

a deck;

a first and a second deck support pontoon adapted to flotationally support the deck on the surface when a liquid is disposed within the tank;

a leg housing adapted to receive a selectively adjustable deck support leg;

the first pontoon being rigidly secured to the leg housing; p1 the second pontoon being pivotally mounted to the leg housing such that the second pontoon may pivot with respect to the longitudinal axis of the first pontoon when the deck flexes in response to turbulence within a liquid disposed within the tank or in response to other non-uniform loading on the deck.

5. The floating cover of claim 4 wherein each of the first and second pontoons is provided with an end plate having a flange thereon, each flange having an opening therein, and wherein the flange associated with the first pontoon is rigidly secured to the leg housing through the opening therein and the flange associated with the second pontoon is pivotally mounted to the leg housing through the opening therein.

6. The floating cover of claim 4 wherein the leg housing has a first and a second ear thereon and wherein each of the first and second pontoons is provided with an end plate having a flange thereon, one flange having a central opening centered on a line coincident with the axis of the pontoon to which it is affixed, the other flange having a top and a bottom slot spaced above and below the opening therein, and wherein the flange associated with the first pontoon is rigidly secured to the first ear of the leg housing through the top and bottom slots of the flange and the flange associated with the second pontoon is pivotally mounted to the second ear of the leg housing through the central opening therein.

* * * * *